United States Patent [19]

Dingler et al.

[11] 4,319,598

[45] Mar. 16, 1982

[54] SOIL SEPARATOR DRAIN VALVE

[75] Inventors: Geoffrey L. Dingler; Wilbur W. Jarvis, both of St. Joseph Township, Berrien County; Raymond W. Spiegel, Lincoln Township, Berrien County, all of Mich.

[73] Assignee: Whirlpool Corporation, Benton Harbor, Mich.

[21] Appl. No.: 189,782

[22] Filed: Sep. 22, 1980

[51] Int. Cl.[3] ..... B08B 3/02

[52] U.S. Cl. ..... 134/57 D; 134/104; 137/387; 210/411

[58] Field of Search ..... 134/57 D, 104, 109, 134/111, 176, 186; 210/411; 241/46 R, 46.17; 137/387, 412

[56] References Cited

U.S. PATENT DOCUMENTS

| | | | |
|---|---|---|---|
| 1,971,588 | 8/1934 | Stoddard et al. | 134/109 |
| 2,664,966 | 1/1954 | Moore | 55/338 X |
| 3,023,757 | 3/1962 | Mixon | 134/176 X |
| 3,313,311 | 4/1967 | Gilson | 134/109 |
| 3,364,860 | 1/1968 | Schmitt-Matzen | 134/186 X |
| 3,434,671 | 3/1969 | Cushing et al. | 241/46 R |
| 3,709,236 | 1/1973 | Field et al. | 134/104 |
| 3,807,419 | 4/1974 | Cushing et al. | 134/104 |
| 3,981,456 | 9/1976 | Hahn et al. | 241/46 R |
| 4,150,680 | 4/1979 | Johnson et al. | 134/104 |
| 4,168,715 | 9/1979 | Spiegel et al. | 134/104 |

*Primary Examiner*—Robert L. Bleutge

*Attorney, Agent, or Firm*—Wegner, Stellman, McCord, Wood & Dalton

[57] ABSTRACT

A dishwasher structure having a centrifugal pump for providing dishwashing liquid to a spray arm thereof. The swirling motion of the dishwashing liquid effected by operation of the pump is utilized to divert a portion of the liquid to an accumulator wherein soil material is collected from the liquid. The cleansed liquid is returned to the pump chamber to be repumped with additional dishwashing liquid. A drain is provided for draining the dishwashing liquid and collected soil at the end of the dishwashing cycle and is controlled by a pressure-responsive drain valve which is operated by differing pressure conditions automatically during dishwashing and drain cycles respectively.

19 Claims, 7 Drawing Figures

FIG. 4
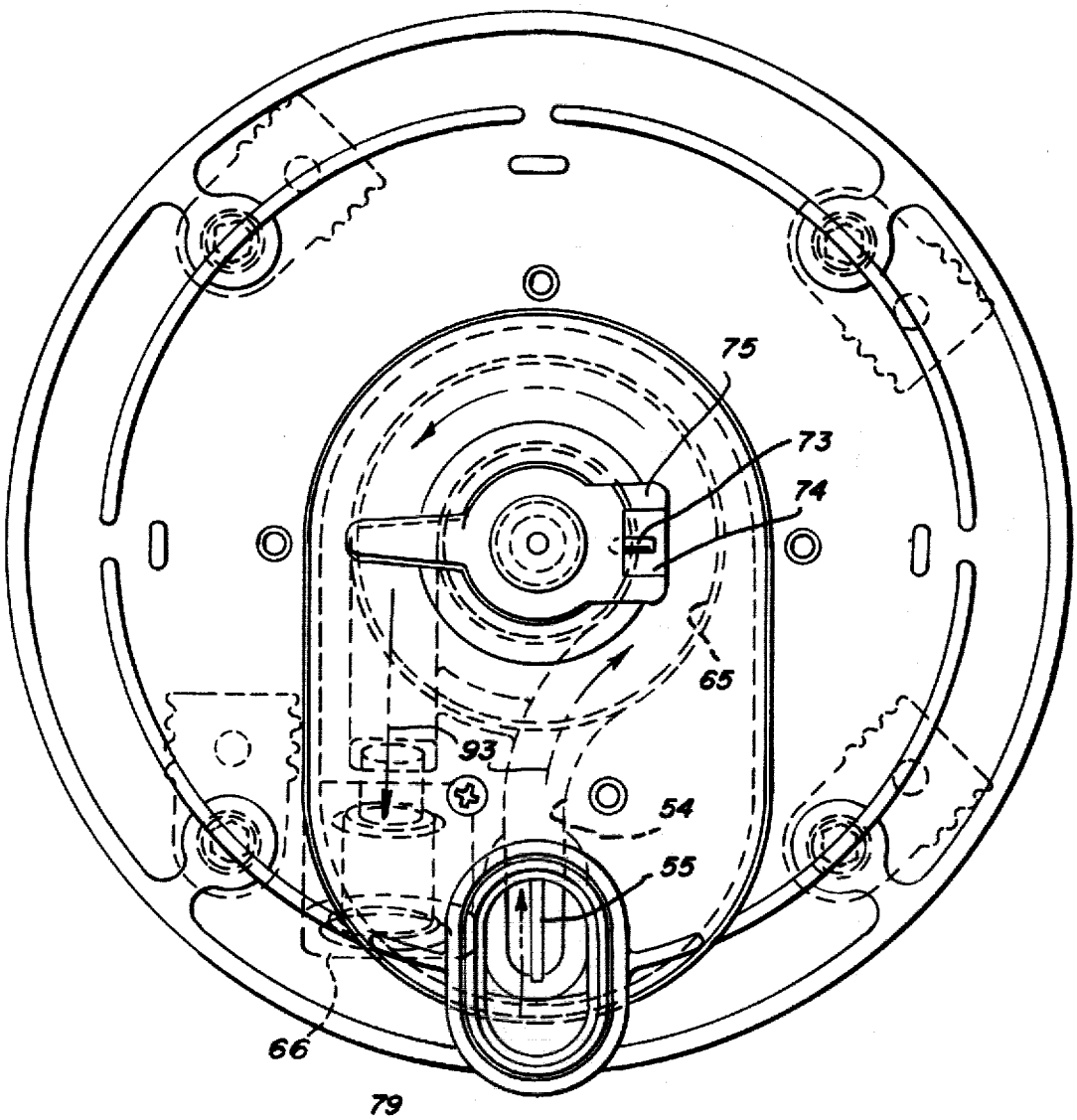
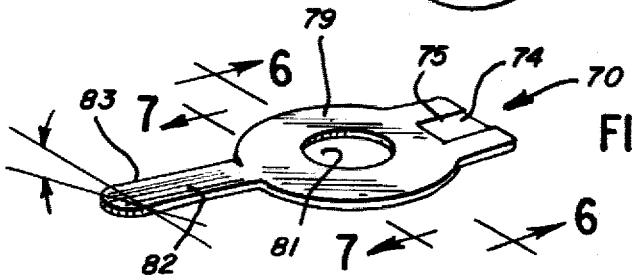
FIG. 5

SOIL SEPARATOR DRAIN VALVE

BACKGROUND OF THE INVENTION

1. Field of the Invention

This invention relates to dishwasher apparatus and in particular to valve means for controlling the drain of dishwashing liquid from the apparatus upon completion of the dishwashing operation.

2. Description of the Background Art

In one form of dishwasher disclosed in U.S. Pat. No. 4,150,680 of Philip P. Johnson et al, which patent is owned by the assignee hereof, an improved structure for separating food soil and the like from the dishwashing liquid is disclosed. The structure is arranged to utilize the combined swirling and longitudinal movement of the dishwashing liquid in the suction passage to the circulation pump for effecting circulation of a portion of the liquid through a soil accumulator having a return passage leading back to the suction portion of the dishwasher liquid circulation means. An impeller is provided in the suction passage for swirling the liquid at relatively high speed to effect the desired transfer of a portion thereof to the soil separating means. The dishwashing liquid is discharged to drain through the soil separator upon completion of the dishwashing operation under the control of a conventional solenoid drain valve.

In U.S. Pat. No. 4,168,715 of Raymond W. Spiegel et al, which patent is also owned by the assignee hereof, another form of soil separator is disclosed in a dishwasher structure wherein the soil separating structure is associated with the suction passage leading to the circulation pump. This structure is arranged to utilize the combined swirling and longitudinal movement of the dishwashing liquid in the suction passage produced by a rotary impeller generally similar to that of the above discussed Johnson et al patent. By suitably arranging ports communicating between the suction passage and the separator, the circulation of a portion of the liquid through the separator is automatically effected. More specifically, as disclosed in the Spiegel et al patent, the swirling liquid in the suction passage is urged outwardly from the suction passage through a radially outwardly disposed port and back into the suction passage through a radially inwardly disposed port as a result of the pressure differential resulting from the different radial spacings of the port from the axis of the swirling means. The drain from the accumulator is controlled by a conventional solenoid valve to drain the collected soil and dishwashing liquid from the apparatus in the drain cycle.

Another form of soil separator is illustrated in U.S. Pat. No. 1,971,588 of E. S. Stoddard et al. As shown therein, the drain pump is arranged to receive heavier soil particles from the tub sump and force them outwardly into the drain conduit which is normally closed by a valve 91. When the valve is opened, the pump drains the dishwashing machine by pumping the liquid from the bottom portion thereof outwardly through the drain so as to carry with the liquid being drained the soil particles previously delivered to the drain conduit. The drain pump is disposed below the sump, whereas the main liquid circulating impeller is disposed at the bottom wall of the tub. The drain line is controlled by a conventional manually operable drain cock.

In the dishwasher structure disclosed in U.S. Pat. No. 3,807,419 of Donald S. Cushing et al, a drain valve is illustrated in FIG. 4 to be disposed within a hopper including a tubular casing defining a soil collection area. An upper opening permits soil particles to be moved downwardly into the soil collection area, a lower opening receives effluent pumped from the sump of the apparatus, and a side opening permits discharge of effluent from the soil collecting area. In the drain cycle, the pump automatically pumps the dishwashing liquid from the washing chamber through the drain line and through the hopper to the final discharge line. The control valve includes a lower valve and an upper valve. When the effluent flow progresses through the drain line, the pressurized flow exerts a force upwardly against the valve member to raise the valve stem. This closes the upper valve. The lower valve is normally spring-biased closed and is opened by the incoming flow from the drain line. The pressurized flow filling the soil collection area leaves through the side opening and vents outwardly through a drain line which is controlled by a check valve. During the washing operation, the valve stem is in its lower-most position to permit the upper opening to pass soil downwardly into the collection area. A flapper valve is provided for independently draining a trough portion of the apparatus when the hopper is being drained. The trough is sealed off from the hopper during the draining operation to permit the desired high pressure condition in the soil collection area.

Soil moves downwardly through the upper opening by gravity flow during the dishwashing operation. The valve closes the opening from the dishwashing chamber so as to prevent a leakage of the collected soil during the dishwashing operation back to the dishwashing chamber from the bottom of the soil collection area.

SUMMARY OF THE INVENTION

The present invention comprehends an improved drain valve means for use in a dishwasher or the like, having an accumulator for removing suspended soil material from the dishwashing liquid during the dishwashing operation.

The drain valve of the present invention is pressure-responsive in effecting the desired control of the drain outlet opening.

More specifically, the pressure-responsive means for operating the drain valve operates the valve to close the drain opening as a result of liquid pressure in the accumulator caused by operation of the wash impeller to circulate the dishwashing liquid for washing dishes in the wash operation. The valve control means includes means for causing the drain impeller to be operated to direct the dishwashing liquid outwardly through the drain opening in a drain operation upon completion of a dishwashing operation. The pressure-responsive means controls the drain valve, operating the drain valve to open the drain opening as a result of a reduction in pressure in the accumulator and the drain operation of the drain impeller.

In the illustrated embodiment, the drain impeller comprises means for providing a liquid pressure acting on the valve means to assist the pressure resulting from operation of the wash impeller to maintain the valve means closed during the dishwashing operation.

The pressure-responsive means, in the illustrated embodiment, comprises a diaphragm valve actuator. In the illustrated embodiment, the diaphragm is subjected to atmospheric pressure on one side.

The valve means, in the illustrated embodiment, comprises a movable member. The drain means includes a passage for conducting dishwashing liquid from the drain impeller to act against the movable member so as to tend to close the outlet during the dishwashing operation.

The apparatus is arranged to provide a suction liquid pressure acting against the movable member tending to open the outlet during the drain operation.

In the illustrated embodiment, the drain impeller is rotatable about an axis and the drain passage opens angularly to the path of rotation about that axis.

The wash impeller is arranged to provide dishwashing liquid to the accumulator during the drain operation.

The wash impeller provides a liquid pressure acting on the pressure-responsive means which is less during the drain operation than during the wash operation.

A ball check is provided for closing the passage between the accumulator and the pump chamber during the drain operation.

In the illustrated embodiment, the valve member is spring-biased to the open position. The pressure-responsive means comprises a diaphragm and means connecting the valve member to the diaphragm and extending through the drain opening.

The drain opens to a bottom portion of the accumulator chamber collecting space.

In the illustrated embodiment, the valve member comprises a frustoconical member widening toward the drain means. The drain opening defines a frustoconical valve seat widening toward the drain means.

The pressure-responsive means includes a valve stem extending through the outlet when the valve member is in the open position.

Thus, the dishwashing apparatus drain valve of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 4 is an enlarged transverse section taken substantially along the line 4—4 of FIG. 2;

FIG. 5 is a perspective view of the soil chopper thereof;

DESCRIPTION OF THE PREFERRED EMBODIMENT

Figure 2:
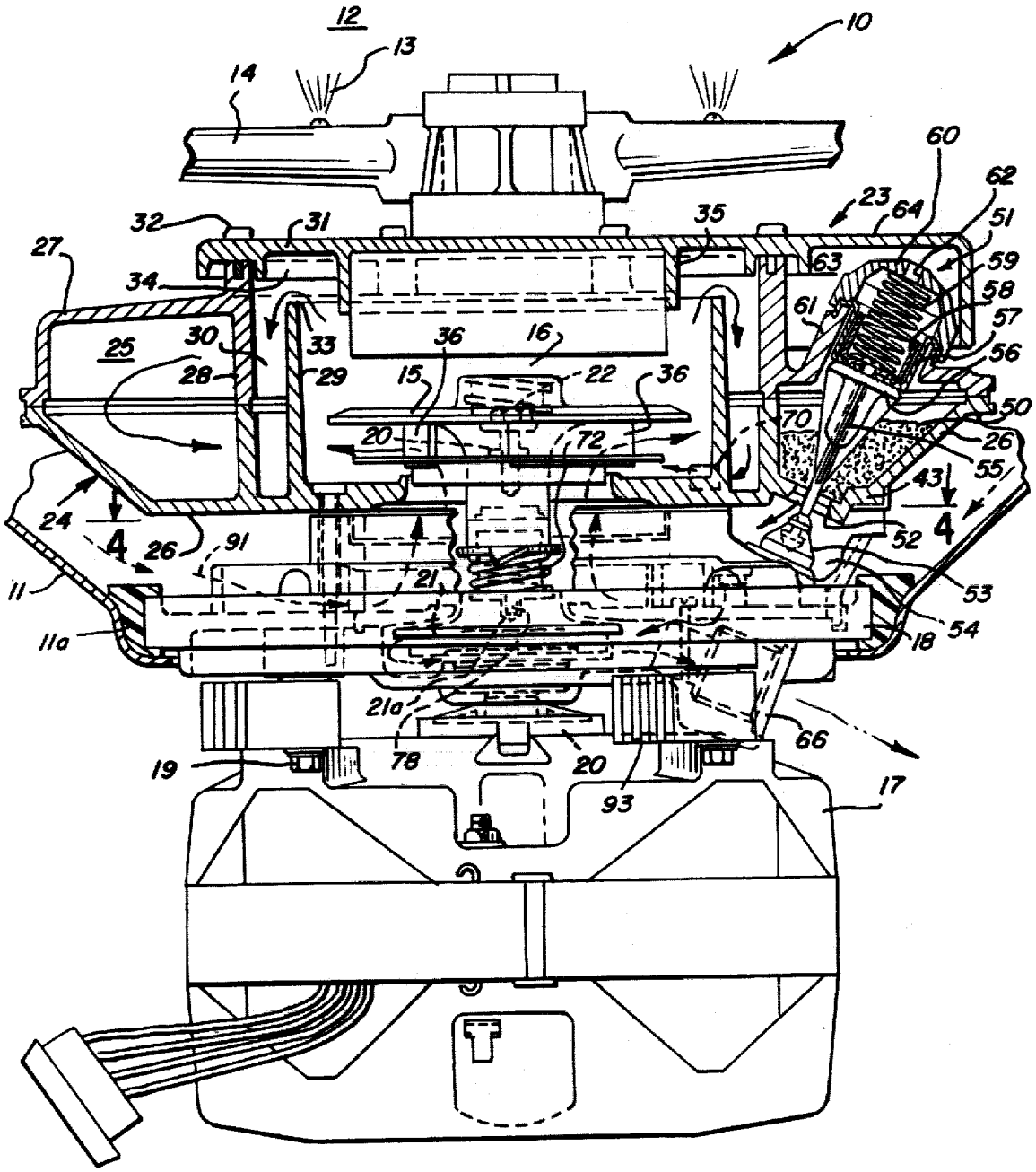
FIG. 2 is a diametric section thereof taken substantially along the line 2—2 of FIG. 1.

In the exemplary embodiment of the invention as disclosed in the drawings, and particularly FIG. 2, a dishwashing apparatus generally designated 10 is shown to comprise a tub 11 defining a dishwashing space 12 in which dishes are retained to be washed by jets 13 of washing liquid delivered through a spray arm 14.

Figure 1:
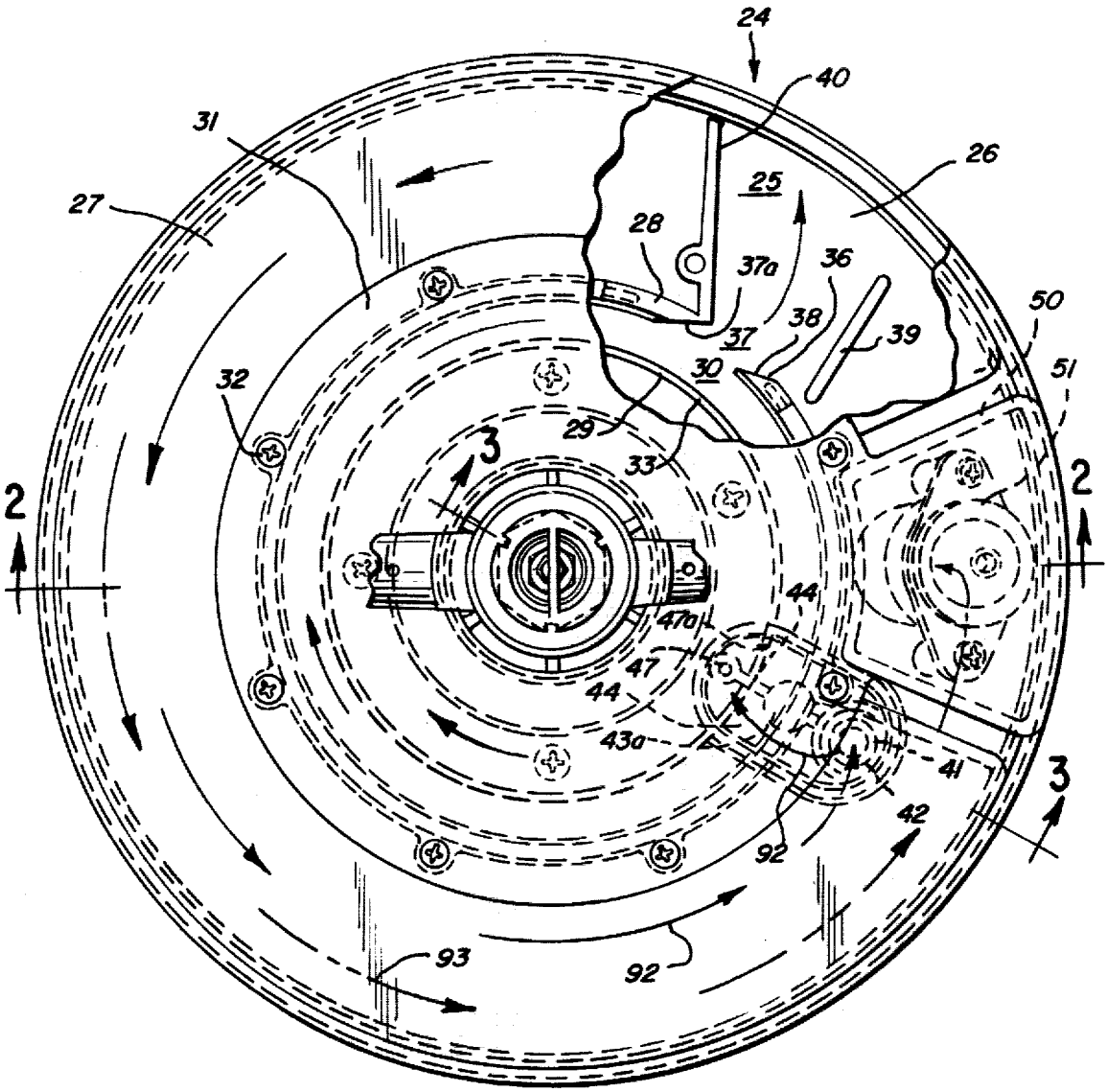
FIG. 1 is a plan view of the dishwasher liquid supply apparatus provided subjacent the spray arm of the dishwasher and with a portion of the cover thereof broken away to illustrate more clearly the flow of a portion of the dishwashing liquid from the guide chamber into the accumulator chamber.

The dishwashing liquid is forced upwardly into the spray arm 14 by a centrifugal pump or recirculation impeller 15 disposed in a pump chamber 16. A pump motor 17 is secured to a drain housing 18 by suitable means, such as bolts 19, and is provided with an output shaft 20 driving a drain pump impeller 21. The shaft 20 extends upwardly from the drain pump for driving the wash pump impeller 15 secured thereto by a retaining bolt 22. Motor 17 comprises a reversible motor. During the dishwashing cycle, the motor rotates in a clockwise direction, as seen in FIG. 1, and thus, wash impeller 15 causes a swirling movement of the dishwashing liquid in pump chamber 16 in a clockwise direction, as well as delivering the dishwashing liquid under a positive pressure to the spray arm 14, as discussed above.

As indicated above, the invention comprehends a novel arrangement of the dishwashing liquid circulating means generally designated 23 which effects an automatic cleansing of the dishwashing liquid during the dishwashing cycles and which subsequently effects an automatic discharge of the soil material collected from the dishwashing liquid in a drain operation wherein the dishwashing liquid is also discharged to a drain. More specifically, the invention comprehends the provision of accumulator chamber means generally designated 24 defining an accumulator chamber 25 in which soil material in the dishwashing liquid is collected during the dishwashing operation. As seen in FIG. 2, the accumulator chamber means 24 is defined by a lower housing 26 and an upper housing 27. Housings 26 and 27 cooperatively define a radially inner wall 28.

As further shown in FIG. 2, housing 26 is provided with an upstanding annular wall 29 radially inwardly of wall 28 so as to define therebetween an annular guide chamber 30. A cover 31 is secured to the top of upper housing 27 by suitable means, such as screws 32. An upper edge 33 of wall 29 is spaced below the cover 31 so as to define therebetween a flow passage 34. Cover 31 further defines a depending annular wall 35 extending downwardly to below the level of the upper edge 33 of wall 29 so that dishwashing liquid must first flow upwardly into flow passage 34, across the top edge 33, and downwardly into the guide chamber 30, as indicated by the arrows in FIG. 2.

Pump impeller 15 is provided with a plurality of blades 36 which are rotated about the axis of the motor shaft 20, so as to discharge the dishwashing liquid being pumped thereby with a swirling movement. Resultingly, the liquid passing through flow passage 34 is caused to have a swirling movement so as to resultingly flow in an annular path through the annular guide chamber 30. Referring now more specifically to FIG. 1, in a preselected position, wall 28 is provided with an opening 37 having edges 37*a* and 38 extending chordally to the annular extent of guide chamber 30 so as to guide a portion of the annularly moving dishwashing liquid outwardly into the accumulator chamber 25. Thus, opening 37 effectively defines a radially inner inlet opening to the accumulator chamber.

Adjacent opening 37, the accumulator chamber is provided with a vertically extending deflector wall 39 which, as seen in FIG. 1, acts to reverse the direction of annular flow of the liquid passing through the inlet opening 37 so that this portion of the dishwashing liquid is then directed in a counterclockwise annular flow through the annular accumulator chamber 25.

As further shown in FIG. 1, adjacent edge 37*a* of the inlet opening 37, the accumulator chamber is provided with a weir 40 upstanding from lower housing portion 26 and generally transversely across the lower portion of the accumulator chamber 25 defined by the lower housing 26. Thus, the portion of the dishwashing liquid flowing into the lower portion of the accumulator chamber through opening 37 is caused to have a reduced velocity of flow as it enters the larger cross-sectional area chamber 25. Deflecting wall 39 and weir 40 combine to straighten the spiral effect of the liquid flowing into chamber 25, thus reducing turbulence within the accumulator channel. Resultingly, soil matter, such as food particles, carried by the dishwashing liquid is caused to settle out from the flowing dishwashing liquid and collect in the lower portion of the accumulator chamber during the dishwashing cycle.

Figure 3:
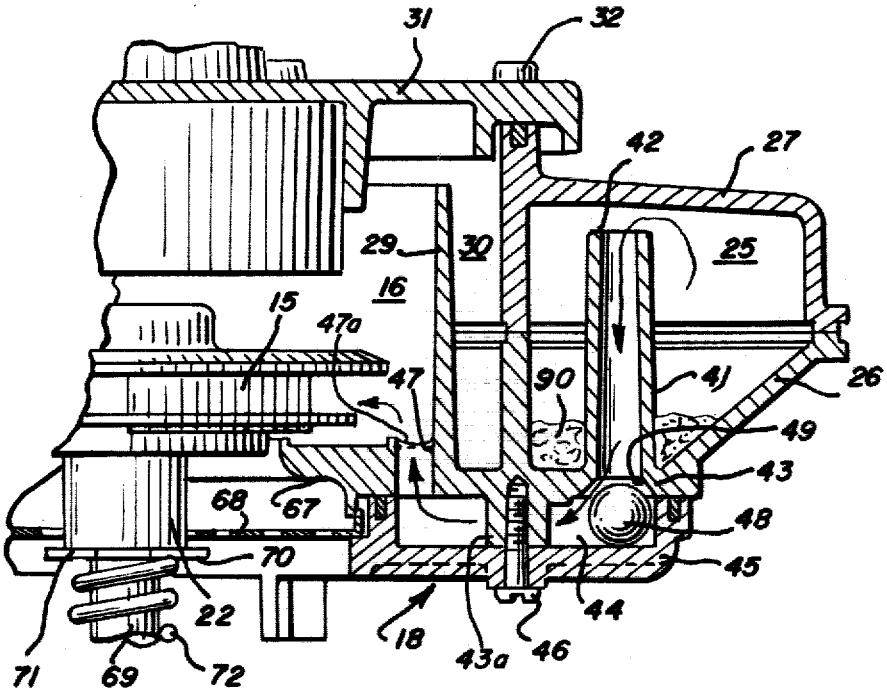
FIG. 3 is a fragmentary enlarged section taken substantially along the line 3—3 of FIG. 1, illustrating the means for returning the cleansed dishwashing liquid to the pump chamber.

The thusly cleansed dishwashing liquid is returned to the pump chamber to be repumped with additional dishwashing liquid by the pump impeller 15. The return passage from the accumulator chamber 25 to the pump chamber 16 is defined by a tubular outlet wall 41, as shown in FIG. 3, having an upper end 42 opening to an upper portion of the accumulator chamber 25. The lower end of the tubular wall 41 opens through a bottom wall 43 of the housing 26 and into a transfer passage 44 defined by a portion 45 of the drain housing 18. As shown in FIG. 3, the drain housing portion 45 may be secured to the bottom wall 43 by suitable means such as a screw 46 which is secured in a boss 43*a*, integral with bottom wall 43. As seen in FIG. 1, passage 44 extends around boss 43*a* and communicates with a return inlet opening 47.

As shown in FIGS. 1 and 3, the return inlet opening 47 from the transfer passage 44 is turned upwardly therefrom to open into pump chamber 16 adjacent wall 29 at the periphery of the pump impeller 15. A ramp 47*a* surrounding a portion of opening 47 helps create a low pressure zone at opening 47 during the clockwise rotation of impeller 15 to increase the flow rate of liquid through the accumulator.

As further illustrated in FIG. 3, means may be provided for preventing backflow of dishwashing liquid through passages 47 and 44 into the outlet 41 of the accumulator chamber and, more specifically, a ball 48 is provided in transfer passage 44 to seat on an annular seat 49 defined by the lower end of the tubular outlet wall 41 facing the transfer passage 44.

The collector soil designated at 90 is retained in the lower portion of the accumulator chamber while the cleansed liquid disposed in the upper portion thereof is transferred through outlet 41 and passage 44 to the pump chamber.

As shown in FIG. 1, accumulator chamber 25 is closed adjacent deflector 39 by a transverse end wall 50. Outlet 41 is spaced in a clockwise direction from end wall 50 and downstream of the outlet. Intermediate the outlet and end wall 50, the accumulator chamber is provided with a drain means 51 which is normally closed during the dishwashing cycle. Referring to FIG. 2, drain means 51 is defined by a drain opening 52 in bottom wall 43 of the housing 26, which is selectively closed by a movable valve means or member 53 disposed in a drain chamber 54 housing drain impeller 21.

As shown in FIG. 2, the drain opening 52 is frustoconical, widening toward the drain chamber 54 and the valve member 53 is frustoconical narrowing toward drain opening 52 so as to have a seated relationship with the portion of the bottom wall 43 defining the drain opening 52 when the valve member is moved upwardly into the drain opening.

Movement of the valve member 53 is effected by a stem 55 carrying the valve member on its lower end, and having an upper connector 56 secured to a flexible diaphragm 57. The backside of the diaphragm is provided with a spring retainer 58 receiving a coil spring 59 compressed between the spring retainer and a cap 60 secured to an annular portion 61 of the housing 27. As shown, cap 60 is provided with a vent opening 62 which opens to a space 63 under an apron 64 projecting from the cover 31. Space 63 is open to atmosphere and, thus, the backside of diaphragm 57 is normally maintained at atmospheric pressure.

During the normal dishwashing cycle, the flow of dishwashing liquid into the accumulator chamber provides a sufficient pressure on the liquid therein so as to urge the diaphragm 57 upwardly against the biasing action of spring 59, thereby seating valve member 53 in the opening 52 and closing the drain. At the same time, the drain pump impeller 21 is being rotated in a clockwise direction together with the wash pump impeller 15 and, thus, tends to urge liquid in a clockwise direction in the drain pump chamber 65 illustrated in FIG. 4. As shown in FIG. 4, chamber 54 opens chordally into chamber 65 so as to receive a portion of the liquid being swirled by the drain pump in the clockwise direction. This liquid then acts on the bottom of the valve member 53 to augment the closing action of the diaphragm 57 on the valve member, thereby effectively assuring a closed condition of the drain during the normal dishwashing cycle.

As further illustrated in FIGS. 2 and 4, the outlet from drain housing 18 is through a drain port 66 which opens downwardly through the bottom of the housing 18, in substantially parallel relationship to the drain passage 54 (FIG. 4).

When it is desired to drain the dishwashing liquid at the completion of a dishwashing cycle, the motor is stopped to allow the pressure in chamber 25 to drop sufficiently to allow biasing spring 59 to unseat valve member 53. The connections to electric motor 17 are then reversed so as to cause counterclockwise operation thereof with concomitant counterclockwise rotation of the wash pump impeller 15 and the drain pump impeller 21. The resultant counterclockwise swirling flow of the dishwashing liquid in the pump chamber causes the annular flow of the dishwashing liquid portion in the guide chamber 30 to flow in a counterclockwise direction past the inlet opening 37. Such counterclockwise flow past the opening does not provide a substantial flow of the dishwashing liquid into the inlet opening and, thus, the pressure of the dishwashing liquid in accumulator chamber 25 remains relatively low, allowing spring 59 of the drain valve to hold the drain valve in the open condition illustrated in FIG. 2.

At the same time, the counterclockwise rotation of the drain pump, as seen in FIG. 4, causes a counterclockwise flow of the drain liquid in the chamber 65 past the opening of passage 54 to the chamber so as to provide a negative pressure in the drain chamber 54, further tending to move the valve member 53 to the open position of FIG. 2. Resultingly, dishwashing liquid flows during the drain cycle through the inlet 37 into the accumulator chamber 25, past the tubular outlet wall 41 and outwardly through the drain opening 52 to carry with it the accumulated soil 90 and discharge the liquid with the soil carried therein through the drain port 66 to a suitable drain. As the drain opening 52 is in the bottom portion of the accumulator chamber, the flow efficiently washes the collected soil 90 outwardly through the drain opening 52 in providing a self-cleaning of the chamber during the drain cycle.

Figure 6:
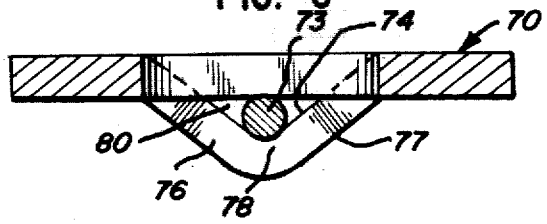
FIG. 6 is an enlarged transverse section taken substantially along the line 6—6 of FIG. 5.

Referring now to FIG. 3, extending across an inlet 67 to pump chamber 16 is a filter screen 68. Portion 69 of the shaft 20 between drain pump impeller 21 and wash pump impeller 15 extends through screen 68 and is provided subjacent the screen with a chopper 70. As shown in FIG. 5, the chopper comprises a blade element, and as illustrated in FIG. 3, the chopper blade is urged against a downwardly facing shoulder 71 on impeller 5 by a coil spring 72. As shown in FIGS. 2 and 4, the upper distal end 73 of the coil spring extends radially outwardly into a V-shaped groove 74 in a radial tongue 75 of the chopper and a lower distal end 78 of the coil spring extends into and is driven in rotation by a blind hole 21*a* in impeller 21. As illustrated in FIG. 6, the groove 74 is defined by a pair of integrally connected deformed wall portions 76 and 77. Resultingly, an opening 80 is provided through which the spring end 73 may extend radially outwardly.

As shown in FIG. 5, the midportion 79 of chopper 70 is provided with a circular bore 81 allowing rotational movement of the chopper with respect to the shaft portion 69.

As further shown in FIG. 5, a turned blade 82 extends radially outwardly from the center portion 79 and is provided with a cutting edge 83 for comminuting soil particles that are trapped on the filter screen so that they may subsequently readily pass through the screen openings.

Figure 7:
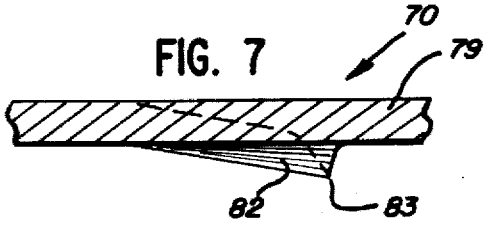
FIG. 7 is a fragmentary transverse section taken substantially along the line 7—7 of FIG. 5.

The resilient drive and mounting of the chopper by means of spring 72 provides an improved chopping action. As shown in FIGS. 5 and 7, the blade 82 is turned from the flat plane of midportion 79 to create turbulence in the liquid adjacent the bottom of the filter screen, facilitating free movement of the soil particles and effectively precluding them from being retained in blocking disposition in the screen openings. Thus, the chopper defines means for effecting self-cleaning of the screen both in comminuting large particles and in causing turbulence in the liquid adjacent the bottom surface to provide a washing action.

In brief recapitulation, the liquid circulating means of dishwasher apparatus 10 provides an improved self-cleaning function in the operation of the apparatus. As shown in FIG. 2, the wash liquid enters the centrifugal pump recirculation impeller 15 as illustrated by broken arrows 91 from the wash chamber 12. That liquid is pumped in a swirling motion by the clockwise rotation of the impeller 15 to the spray arm 14. As the liquid is pumped, the motion imparted to the liquid causes the soil particles to be centrifugally forced outwardly toward annular wall 29. That portion of the liquid containing the soil particles flows over the wall 29, into guide chamber 30 and through the accumulator chamber 25 for cleansing of the liquid and back to pump impeller 15 as illustrated by the solid arrows 92 (FIGS. 1, 2 and 3). The pressure in chamber 25 during a dishwashing operation closes the drain opening 52 by movement of valve member 53 into the opening. By reversing the direction of rotation of the motor 17, the impellers 15 and 21 are reversed to counterclockwise rotation, opening drain opening 52 and causing the liquid flow through the accumulator chamber 25 to wash out the soil particles for flow through the drain pump chamber 65 and out drain port 66 as illustrated in FIG. 4 by the partially broken arrows 93. The soil accumulator is arranged in a compact manner about the wash pump for improved facilitated cleansing of the dishwashing liquid during the dishwashing cycle. Improved means are provided for removing the collected soil material in the drain operation following completion of the dishwashing operation. An improved chopper means is provided for further improving the recirculation of the dishwashing liquid and effecting an improved dishwashing operation.

In broad aspect, the improvement comprises the provision of pressure-responsive means for operating the valve means to close the drain opening as a result of liquid pressure in the accumulator caused by operation of the wash impeller to circulate the dishwashing liquid for washing dishes in a wash operation, means for causing the drain impeller to be operated to direct the dishwashing liquid outwardly through the drain opening in a drain operation upon completion of a dishwashing operation, the pressure-responsive means operating the valve means to open the drain opening as a result of a reduction in pressure in the accumulator and the drain operation of the drain impeller.

The drain valve apparatus of the present invention is extremely simple and economical of construction while yet providing the highly desirable improved functioning discussed above.

The foregoing disclosure of specific embodiments is illustrative of the broad inventive concepts comprehended by the invention.

We claim:

1. In a dishwasher having spray means, a rotatable wash impeller for circulating dishwashing liquid to said spray means for washing dishes in said dishwasher, means defining an accumulator chamber, means for conducting dishwashing liquid from said wash impeller to the accumulator chamber, said accumulator chamber defining means for collecting soil from the dishwashing liquid to define cleansed dishwashing liquid, means for conducting the cleansed dishwashing liquid to the wash impeller, drain means for conducting the collected soil from the accumulator chamber, said drain means defining a drain opening to said accumulator chamber, said drain means further including a rotatable drain impeller, and valve means for selectively closing said drain opening, the improvement comprising:

pressure-responsive means for operating said valve means to close said drain opening as a result of liquid pressure built up in said accumulator chamber caused by operation of said wash impeller to circulate the dishwashing liquid for washing dishes in a wash operation; and means for causing said drain impeller to be operated to direct the dishwashing liquid outwardly through said drain means in a drain operation upon completion of a dishwashing operation, said pressure-responsive means operating said valve means to open said drain opening as a result of a reduction in pressure in said accumulator chamber, said drain impeller further tending to move said valve means to open said drain opening during said drain operation.

2. The dishwasher structure of claim 1 wherein said drain impeller comprises means for providing a liquid pressure acting on said valve means to assist the pressure resulting from operation of the wash impeller to maintain said valve means closed during the dishwashing operation.

3. The dishwasher structure of claim 1 wherein said pressure-responsive means comprises a diaphragm valve actuator.

4. The dishwasher structure of claim 1 wherein said pressure-responsive means comprises a diaphragm valve actuator having one side subjected to atmospheric pressure.

5. The dishwasher structure of claim 1 wherein said valve means comprises a movable member, and said drain means includes a passage for conducting dishwashing liquid from said drain impeller to act against said movable member tending to close said drain opening during the dishwashing operation.

6. The dishwasher structure of claim 1 wherein said valve means comprises a movable member, and said drain means includes a passage for conducting dishwashing liquid from said drain impeller to act against said movable member tending to close said drain opening during the dishwashing operation and providing a suction liquid pressure acting against said movable member tending to open said outlet during said drain operation.

7. The dishwasher structure of claim 1 wherein said valve means comprises a movable member, and said drain means includes a passage for conducting dishwashing liquid from said drain impeller to act against said movable member tending to close said outlet during the dishwashing operation and providing a suction liquid pressure acting against said movable member tending to open said outlet during said drain operation, said drain impeller being rotatable about an axis and said drain passage opening angularly to the path of rotation of the drain impeller about said axis.

8. The dishwasher structure of claim 1 wherein said wash impeller provides dishwashing liquid to said accumulator during the drain operation.

9. The dishwasher structure of claim 1 wherein said wash impeller provides a liquid pressure acting on said pressure-responsive means which is less during the drain operation than during the wash operation.

10. The dishwasher structure of claim 1 wherein means are provided for ceasing operation of said wash impeller after said wash operation to reduce said pressure build up in said accumulator chamber.

11. The dishwasher structure of claim 1 further including ball check means for closing the means for conducting the cleansed dishwashing liquid to the impeller during the drain operation.

12. In a dishwasher having spray means, a rotatable wash impeller for circulating dishwashing liquid to said spray means for washing dishes in said dishwasher, means defining an accumulator chamber, guide chamber means for transferring a portion of the dishwashing liquid delivered from said impeller to the accumulator chamber, said accumulator chamber defining a collecting space for collecting soil from the dishwashing liquid to provide cleansed dishwashing liquid, means for conducting the cleansed dishwashing liquid back to the impeller for circulation thereby, drain means for conducting the collected soil and dishwashing liquid from the accumulator chamber collecting space, said drain means defining a drain opening to said collecting space adjacent the collected soil, said drain means further including a rotatable drain impeller, and a movable valve member selectively closing said drain opening, the improvement comprising:

pressure-responsive means for selectively positioning said valve member to close said outlet as a result of liquid pressure built up in said accumulator chamber caused by operation of said wash impeller in a wash operation; and means for causing said drain impeller to be selectively operated to direct the dishwashing liquid outwardly through said drain means in a drain operation upon completion of the washing operation, said pressure-responsive means positioning said valve member to open said drain opening as a result of a reduced pressure in said accumulator chamber upon completion of said wash operation.

13. The dishwasher structure of claim 12 wherein said valve member is spring biased to the open position.

14. The dishwasher structure of claim 12 wherein said pressure-responsive means comprises a diaphragm and means connecting the valve member to the diaphragm and extending through said drain opening.

15. The dishwasher structure of claim 12 wherein said drain opening opens to a bottom portion of the accumulator chamber collection space.

16. The dishwasher structure of claim 12 wherein said drain impeller defines means for causing a suction pressure in said drain means tending to move said valve member to the open position during the drain operation.

17. The dishwasher structure of claim 12 wherein said valve member comprises a frustoconical member widening toward said drain means.

18. The dishwasher structure of claim 12 wherein said valve member comprises a frustoconical member widening toward said drain means and said outlet defines a frustoconical valve seat widening toward said drain means.

19. The dishwasher structure of claim 12 wherein said valve member comprises a frustoconical member widening toward said drain means and said outlet defines a frustoconical valve seat widening toward said drain means, said pressure-responsive means including a valve stem extending through said drain opening when the valve member is in the open position.

* * * * *